United States Patent [19]

Iwao et al.

[11] Patent Number: 4,467,556

[45] Date of Patent: Aug. 28, 1984

[54] TOY VEHICLE CAPABLE OF CHANGING SIZE AND SHAPE

[75] Inventors: Noriaki Iwao, Japan; Akira Abe, both of Tokyo, Japan

[73] Assignee: Tomy Kogyo Company, Inc., Japan

[21] Appl. No.: 324,737

[22] Filed: Nov. 25, 1981

Related U.S. Application Data

[63] Continuation-in-part of Ser. No. 170,260, Jul. 18, 1980, abandoned.

[51] Int. Cl.[3] ..... A63H 11/10

[52] U.S. Cl. ..... 446/230; 446/432; 446/470

[58] Field of Search ..... 46/201, 202, 97, 98, 46/112, 16, 17

[56] References Cited

U.S. PATENT DOCUMENTS

| | | | |
|---|---|---|---|
| 2,272,643 | 2/1942 | Peters et al. | 46/201 |
| 2,503,707 | 4/1950 | Bramah | 46/201 |
| 4,032,295 | 6/1977 | Meyer et al. | 46/202 |
| 4,194,318 | 3/1980 | Watanabe | 46/202 |

FOREIGN PATENT DOCUMENTS

| | | | |
|---|---|---|---|
| 2310539 | 9/1973 | Fed. Rep. of Germany | 46/201 |

*Primary Examiner*—Gene Mancene
*Assistant Examiner*—James Hakomaki
*Attorney, Agent, or Firm*—K. H. Boswell; Edward D. O'Brian

[57] ABSTRACT

A toy vehicle which is capable of changing both its size and shape has a compound vehicle chassis having a first and a second chassis member. The chassis members are movable with respect to one another. The chassis members are connected together such that they can be moved with respect to one another reversibly between a first position and a second position. The body of the vehicle includes at least one movable member which is movably associated with one of the chassis members and is movable with respect to the chassis member with which it is associated with between two positions. The spatial relationship between parts of the body of the vehicle is changeable in conjunction with movement of the chassis members and the movable member between their respective positions.

5 Claims, 10 Drawing Figures

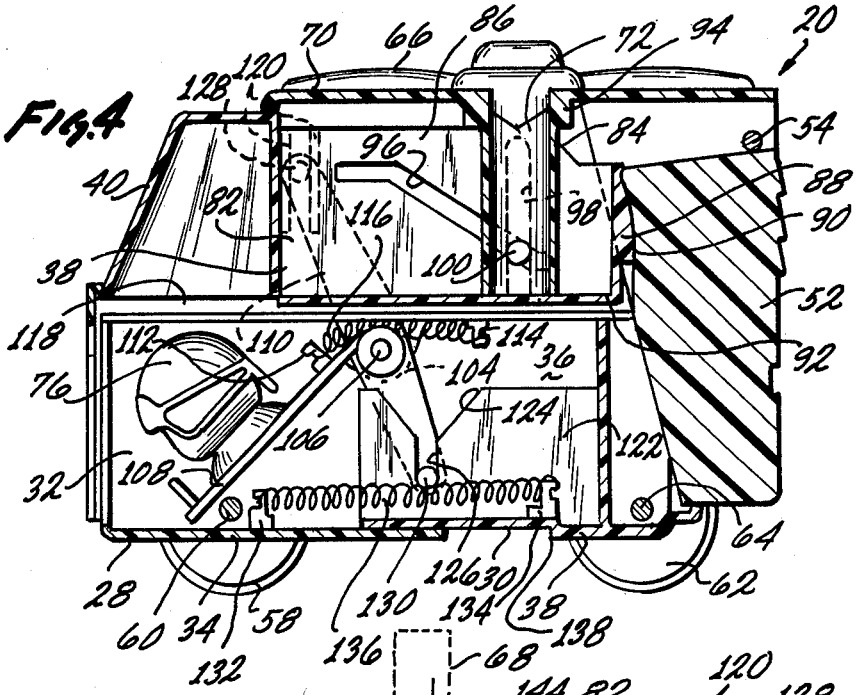
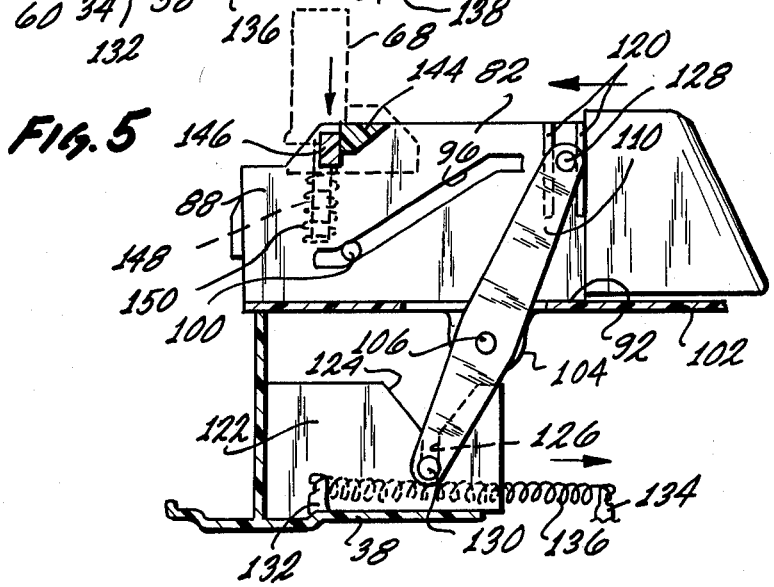
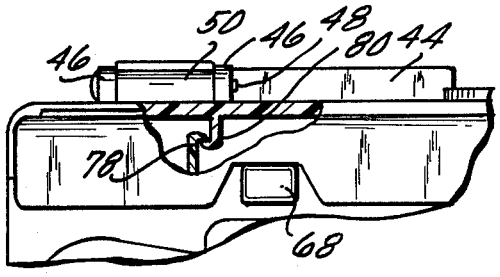
Fig.7

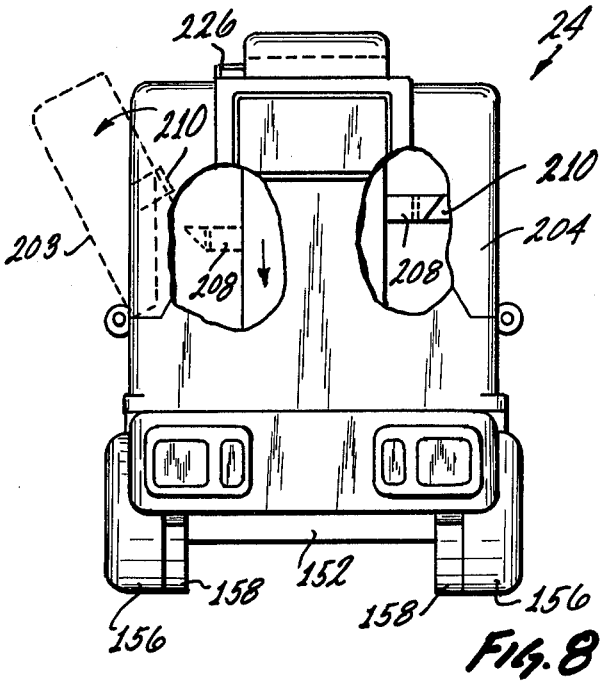
FIG. 8
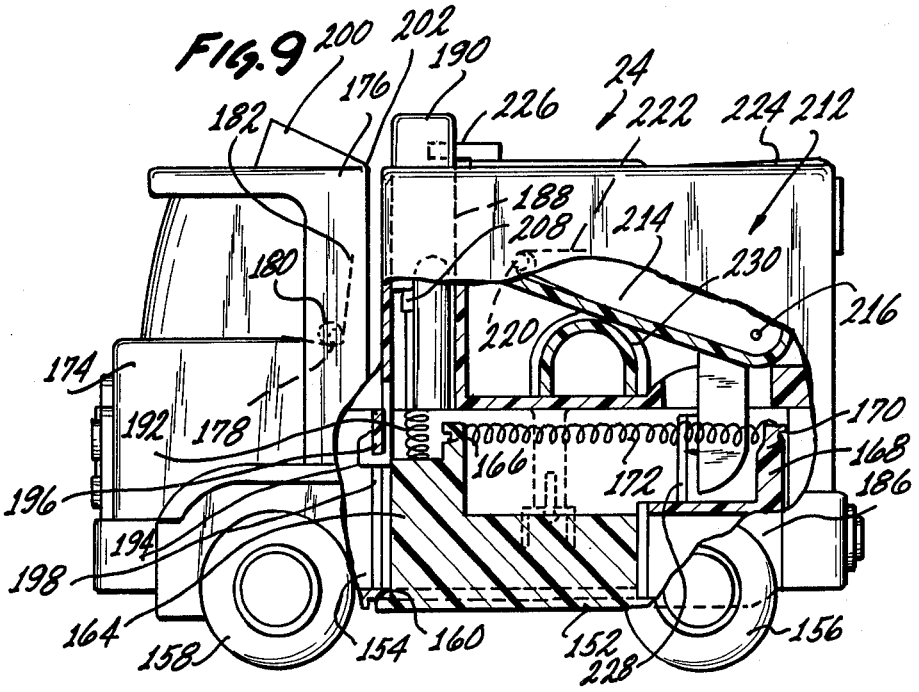

TOY VEHICLE CAPABLE OF CHANGING SIZE AND SHAPE

CROSS REFERENCE TO RELATED APPLICATIONS

This application is a continuation-in-part of our application Ser. No. 170,260 filed July 18, 1980 and entitled TOY VEHICLE CAPABLE OF CHANGING SIZE AND SHAPE, now abandoned, the entire disclosure of which is herein incorporated by reference. This application is also related to our application Ser. No. 324,734 concurrently filed with this application and also entitled TOY VEHICLE CAPABLE OF CHANGING SIZE AND SHAPE, the entire disclosure of which is also herein incorporated by reference.

BACKGROUND OF THE INVENTION

A toy vehicle is described which has the ability to change both its size and shape. These changes are predicated on movement of the members of a compound chassis.

Many toy vehicles are known which simulate actual existing vehicles such as trucks, cars, boats, planes and the like. Small children derive considerable entertainment with playing with the same. Many of these toy vehicles contain functional parts such as movable beds on dump trucks allowing them to actually contain and then dispose of a small amount of dirt, sand or the like, or pivotable cranes, rotating propellers and other movable parts.

Children in playing, utilize their imagination to augment their toys to mimic real life experiences they have been exposed to or have otherwise been educated to. The child's mind is capable of transposing his toys into a fantasy world. Children have been known to pretend that one toy such as a toy truck is another toy such as an airplane when in reality it is not. At present there are no known toy vehicles which in fact in a first instance appear to mimic one type of vehicle and in a second instance appear to mimic a second type of vehicle. It is therefore considered that any toy vehicle which has the capabilities of in one instance mimicking a first type of vehicle, and in a second instance mimicking a second type of vehicle would be exceedingly fascinating to a child. Further, such a dual personality-type vehicle would expand the child's collection of toys while representing both economy in purchasing of the toy and storage space in storing the toy.

BRIEF SUMMARY OF THE INVENTION

In view of the above it is an object of this invention to provide a toy vehicle which in fact could be considered to have a dual personality. By this it is meant that the toy vehicle would be capable in a first instance of representing one type of vehicle and in a second instance representing a second type of vehicle. It is a further object of this invention to provide a toy vehicle which, in combination with changing its character as discussed, is also capable of changing its dimension. Further, it is an object to provide a toy which the child can rapidly transfer back and forth in regard to both shape and size discussed above, thus facilitating the active use of the child's imagination. Also it is an object to provide a toy that, because of its engineering principles and brevity of parts, is capable of performing as outlined above yet is still economical to manufacture and therefore economical to the consumer.

These and other objects as will be evident from the remainder of this specification are achieved in a toy vehicle which comprises a compound vehicle chassis having at least a first chassis member and a second chassis member, said first and said second chassis members being movable with respect to one another; connecting means operatively associated with both said first chassis member and said second chassis member movably connecting said first and said second chassis members such that said first and said second chassis members can move reversibly between a first stable position wherein said first and said second chassis members are located in a first chassis configuration with respect to one another and a second stable position wherein said first and said second chassis members are located in a second chassis configuration with respect to one another, said compound vehicular chassis being of a greater length when said first and said second chassis members are in said first chassis configuration compared to the length of said compound vehicular chassis when said first and said second chassis members are in said second chassis configuration; a vehicle body having a plurality of surface features forming the outside surface of said vehicle, at least a portion of said plurality of said surface features being fixedly located on said first chassis member, at least one of said surface features being located on a first movable member which is operatively associated with said first chassis member and movable with respect to said first chassis member between a first movable member first position and a first movable member second position; said movable first member moving from said first movable member first position to said first movable member second position in response to said first and said second chassis members moving from said first chassis configuration to said second chassis configuration and said movable member moving from said first movable member second position to said first movable member first position in response to said first and said second chassis members moving from said second chassis configuration to said first chassis configuration; said movable member and said second chassis member moving in opposite directions with respect to said first chassis member in moving between said first movable member first and second positions and said first and said second chassis configurations respectively; at least one of said surface features being located on at least one second movable member which is operatively associated with one of said first or said second chassis members, the surface features on each of said first movable member and said second movable member being different than the surface features on the other of these movable members; the shape of said vehicle as determined by the spatial relationship between said plurality of surface features being different when said first and said second chassis members are in said first chassis configuration and when said first and said second chassis members are in said second chassis configuration.

Further, the dimensional scale of the vehicle is also changeable with respect to the change of the position of the chassis members between the first position and the second position.

Preferredly, the connecting means includes biasing means operatively associated with the chassis members to bias the chassis members into one of the positions and retaining means also associated with the chassis members to maintain the chassis members in the other of the positions against the bias of the biasing means. In the preferred embodiment the connecting means also includes a portion of one of the chassis members sized and shaped to slide within a portion of the other of the chassis members. These portions can be U-shaped channels which fit within one another.

The preferred embodiment of the invention includes each of the chassis members having a vehicle support component located thereon which in combination supports the totality of the vehicle above a support surface. Where appropriate, when the vehicles are land vehicles or vehicles capable of resting on land, these support components will comprise wheels rotatably mounted to the chassis members. In such a wheeled vehicle the wheel base of the vehicle is changeable with respect to movement of the chassis members between the first and second positions.

In one aspect of the invention the first movable member is slidably associated with the first chassis member and slides with respect to the first chassis member between a first movable member first position and a first movable member second position. A second connecting means can be operatively associated with the first movable member and the second chassis member such that it is capable of transferring motion from one of these components to the other of these components and vice versa. This second connecting means can comprise a lever means operatively associated with both the first movable member and the second chassis member to transfer motion inbetween these two components.

In a second aspect of the invention the first movable member can be pivotably associated with the first chassis member and pivot with respect to the chassis member between a first movable member position and a second movable member position. When the first movable member is such a pivotable member the length of the toy as measured from the foremost portion of the first chassis member to the rearmost portion of this pivotable movable member is of a greater dimension when the first and second vehicular chassis are in the second chassis configuration compared to when they are in the first chassis configuration.

In another aspect of the invention at least two first movable members can be utilized each of which is operatively associated with the first chassis member and movable with respect to the first chassis member between the first and second positions. Each of these first movable members will include at least one of these features located thereon. One of these movable members can be slidably associated with the first chassis member and slide with respect to the first chassis member between a first slidable member position and a second slidable member position and the other of these movable members can be pivotably associated with the first chassis member and pivot with respect to the first chassis member between a first pivotable position and a second pivotable position. A lever means can operatively attach between the slidable movable member and the second chassis member to transfer motion from one of these to the other. The slidably movable member can be operatively associated with the pivotable movable member such that the pivotable movable member moves in response to movement of the slidable movable member. Preferredly, the lever means would comprise a first class lever which pivots about the first chassis member and has its respective ends associated with the slidable movable member and the second chassis member.

The second movable member located in association with the second chassis member can comprise one, but preferredly two, members located on the second chassis member and movable between positions such that in one position the width of the toy vehicle is wider than the width of the toy vehicle when these members are in the other position. Additionally, other members can be formed as a part of the vehicle such as a rotating member capable of moving with respect to the vehicle in a rotary manner. This member can also be made to move between a first position and a second position depending on which of the chassis configurations the first and second chassis members are located in.

BRIEF DESCRIPTION OF THE DRAWINGS

This invention will be more fully understood when taken in conjunction with the drawings wherein:

FIG. 4 is a side elevational view in partial section of the embodiment of FIG. 1 with the configuration of the vehicle depicted in FIG. 1;

FIG. 5 is a side elevational view in partial section of certain of the components located within the interior of the embodiment of FIG. 1; however, in this figure these components are shown in the spatial relationship they would have for FIG. 3 and further compared to FIG. 4, the components have been rotated 180° through the plane of the figures;

FIG. 7 is a top plan view in partial section of the upper edge of the embodiment depicted in FIG. 5;

FIG. 8 is a front elevational view in partial section of a second embodiment of the invention showing this embodiment in a first configuration and including an alternate position of one of the components shown in phantom;

FIG. 9 is a side elevational view in partial section of the embodiment shown in FIG. 8.

Figure 1:
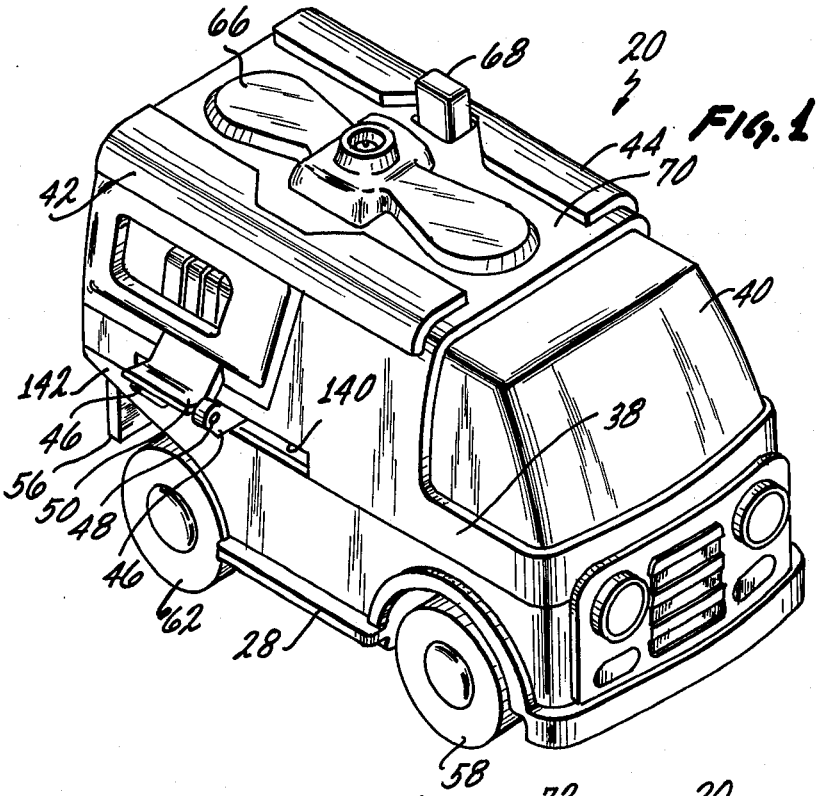
FIG. 1 is an isometric view of a first embodiment of the invention in one of its alternate configurations.

The invention illustrated in the drawings and described in the specification utilizes certain principles and/or concepts that are set forth and claimed in the claims appended to this specification. Those skilled in the toy arts will realize that these principles and/or concepts can be utilized in a number of embodiments differing from the exact embodiments herein depicted, but still falling within the scope of the claims. For this reason this invention is to be construed in light of the claims and is not to be construed as being limited to the exact embodiments herein depicted and described.

DETAILED DESCRIPTION

This invention is directed to vehicles which are capable of changing both their dimensions and shape. For the purposes of this specification the term "vehicle" will be construed as meaning any form of transportation which is capable of carrying either a passenger or a payload of some other sort. This definition would therefore include certain land vehicles such as cars, trucks, buses, certain aquatic vehicles such as boats, amphibeus vehicles which are in fact hybrids of the above noted land and aquatic vehicles and vehicles capable of moving through the air, such as airplanes and helicopters.

Figure 10:
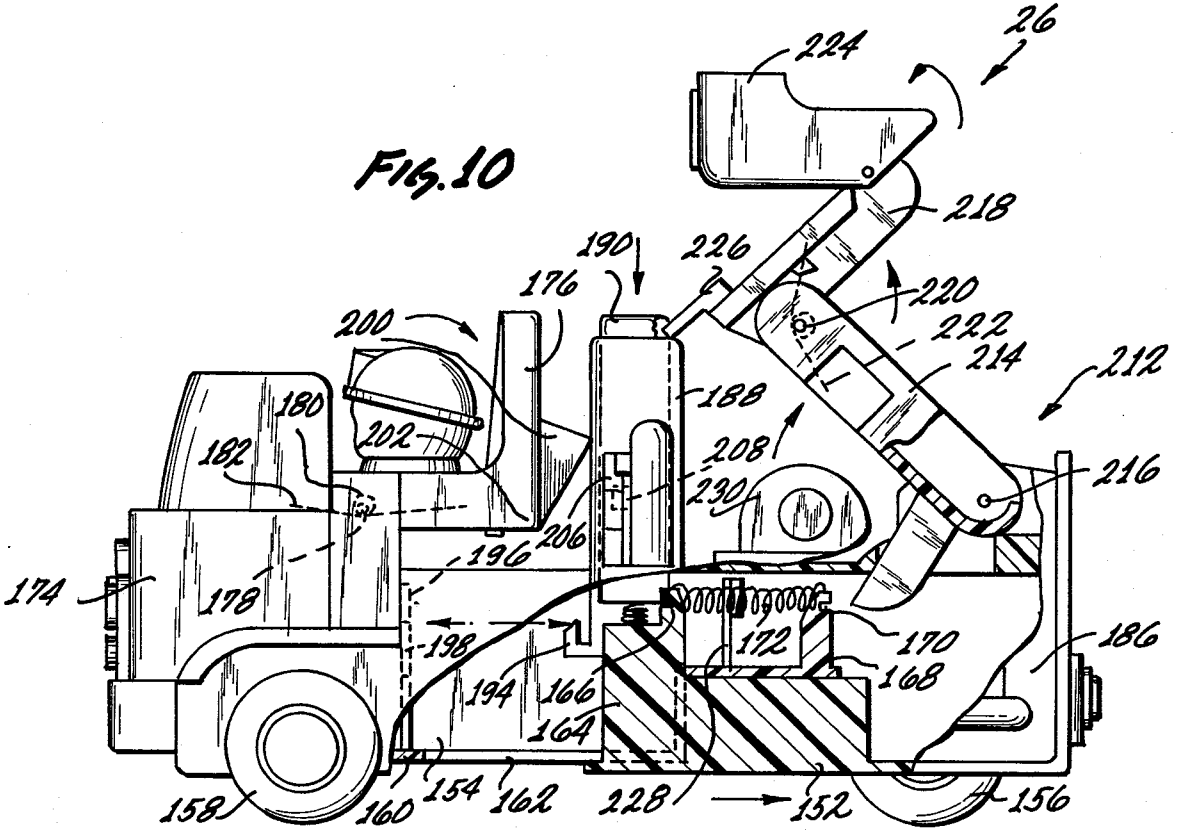
FIG. 10 is a side elevational view of the embodiment shown in FIGS. 8 and 9 showing this embodiment in its alternate configuration.

Two embodiments of this invention are herein described—the first embodiment forming the subject matter depicted in FIGS. 1 through 7 and the second embodiment forming the subject matter depicted in FIGS. 8 through 10. Each of these embodiments is capable of expression in two independent forms or configurations. In order to aid in understanding as to which of the configurations is being discussed, each of the configurations of each of the embodiments will be given an independent identification number.

The first embodiment depicted in FIGS. 1 through 7 is capable of assuming the configuration of a van 20 seen in FIGS. 1, 4 and 7 and a helicopter 22 seen in FIGS. 2, 3, 5 and 6. The second embodiment depicted in FIGS. 8 through 10 is capable of assuming a configuration of a truck 24 depicted in FIGS. 8 and 9 and a hook and ladder type firetruck 26 depicted in FIG. 10. Each of the embodiments includes a compound chassis (not numbered at this time) and a compound body (also not numbered at this time). In moving between the van 20 and the helicopter 22 for the first embodiment and the truck 24 and the firetruck 26 for the second embodiment, both the chassis components and the body components of each of the embodiments assume different spatial relationships with regard to other components.

In discussing each of the individual embodiments certain of the components serve as one structure in one of the configurations and a second structure in the other of the configurations. Since these are the exact same components they will be identified by a single numeral and identified in a general manner. However, they will also be discussed, in some instances, in more explicit terminology which refers only to one of the two configurations. However, the use of the same numerals will be maintained.

Figure 6:
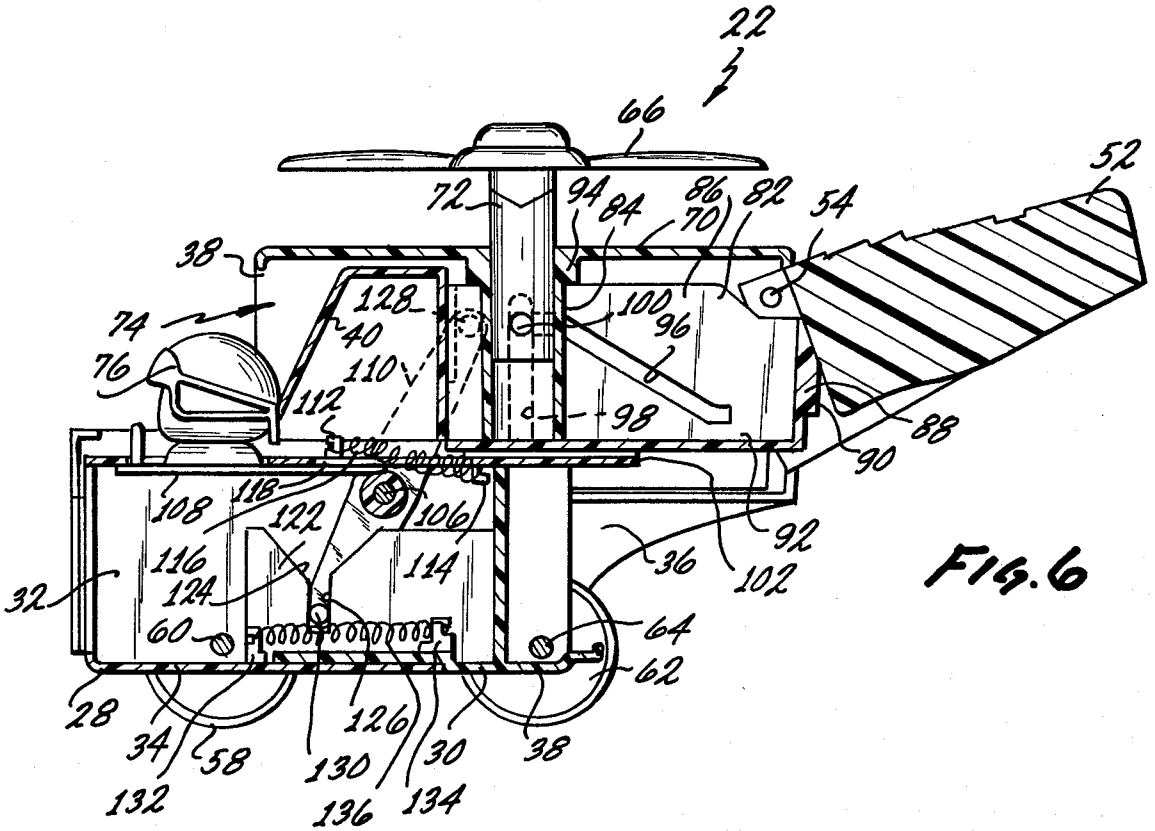
FIG. 6 is a side elevational view in partial section of the vehicle of the embodiment depicted in FIGS. 1 and 3 showing the vehicle in the configuration depicted in FIG. 3.

The van 20 and helicopter 22 have a first chassis member 28 and a second chassis member 30. In the van 20 these chassis members are located with respect to one another as is best depicted in FIG. 4. In the helicopter 22 the chassis member 30 slides within the chassis member 28 as can be seen in FIG. 6. Both the chassis member 28 and the chassis member 30 contain a U-shaped channel (not separated numbered). For chassis member 28 this channel is defined by right side wall 32 and bottom wall 34 as seen in FIG. 4 in combination with a second left side wall (not shown or numbered) identical to side wall 32. The U-shaped channel in chassis member 30 is defined by right side wall 36, bottom wall 38 and a second left side wall (not shown or numbered) identical to side wall 32. The channel in chassis 28 is sized to accept chassis member 30 such that chassis member 30 is free to slide back and forth within certain limits of travel within chassis member 28 as more fully explained hereinafter.

Fixedly mounted to chassis member 28 is main body panel 38. Projecting out of the front of main body panel 38 is a van windshield 40. Located near the back of and on the right and left sides respectively of main body panel 38 are right and left pivotable panels 42 and 44. In the van 20 the panels 42 and 44 form side panels for the van 20. In the helicopter 22 the panels 42 and 44 form landing skirts.

Figure 2:
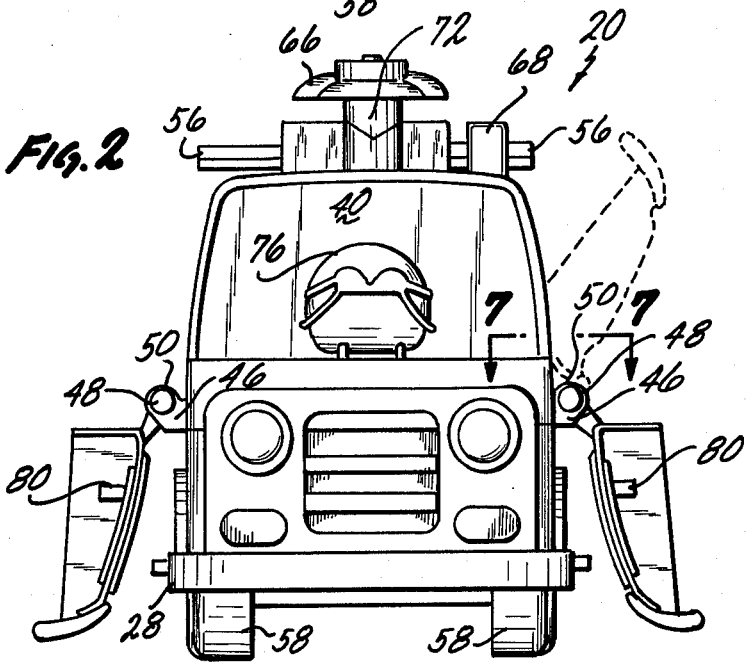
FIG. 2 is a front elevational view of the embodiment shown in FIG. 1 and including an alternate position of one of the components shown in phantom.
Figure 3:
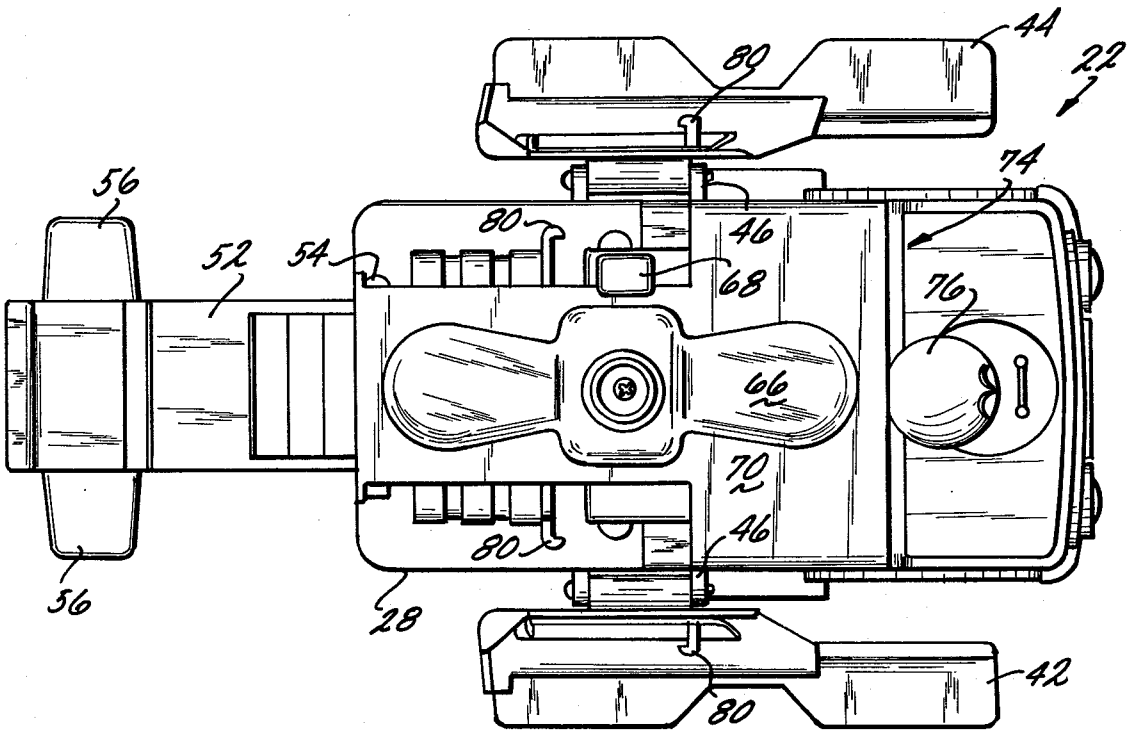
FIG. 3 is a top plan view of the embodiment shown in FIG. 1 except that it is shown in the other alternate configuration achieved by having certain of its components in a different spatial relationship, thus rendering this configuration different with respect to both size and shape than is depicted in FIG. 1.

The panels 42 and 44 are pivotably mounted to chassis member 30 via identical bearings collectively identified by numeral 46 mounted on chassis member 30 which accept axles collectively identified by numeral 48 which pass through bearings collectively identified by numeral 50 integrally formed on panels 42 and 44. This allows the panels 42 and 44 to pivot or swivel up and down as is depicted in FIG. 2 by the solid and phantom renditions of these panels. In addition to the up and down movement, panels 42 and 44 are capable of moving fore and aft with respect to main body panel 38 and chassis member 28. As noted above, the main body panel 38 is attached to chassis member 28. Since the panels 42 and 44 are mounted to chassis member 30, as chassis member 30 moves with respect to chassis member 28, the panels 42 and 44 also move with respect to both chassis member 28 and main body panel 38.

Hinged to the rear of main body panel 38 is rear body panel 52. In the embodiment depicted by the van 20 the panel 52 forms the rear surface and rear bumper of the van 20. In the helicopter 22 the rear body panel 52 swings outwardly and upwardly and forms the tail surface of the helicopter 22. Rear body panel 52 is hinged to main body panel 38 by axle 54 which passes through appropriate openings (not numbered) in main body panel 38 and rear body panel 52. Projections collectively identified by the numeral 56 on the rear body panel 52 serve both as the rear bumper for the van 20 and as stabilizing ailerons for the helicopter 22.

A right and left front wheel collectively identified by the numeral 58 is appropriately mounted to chassis member 28 by an axle 60. A right and left rear wheel collectively identified by the numeral 62 is appropriately mounted by an axle 64 to chassis member 30. As will be discussed hereinafter the wheel base between the front wheels 58 and the rear wheels 62 change in changing from the van 20 to the helicopter 22.

Located on both the upper surface of the van 20 and the helicopter 22 are rotor 66 and button 68. In the van 20 the rotor 66 fits flush against the upper surface 70 of main body panel 38 and in the helicopter 22 the rotor 66 is elevated on shaft 72 from the upper surface 70. In both the van 20 and the helicopter 22 the button 68 is exposed for manipulation by the operator of the toy. The button 68 controls changing the van 20 to the helicopter 22 as hereinafter described. In order to convert back from the helicopter 22 to the van 20 the rear body panel 52 is depressed downwardly and inwardly which as hereinafter described causes certain other components to change their orientation. Both the van 20 and the helicopter 22 as well as the truck 24 and the firetruck 26 contain other vehicular components (not numbered) which contribute to their outward appearance. These would include such things as the front grill, engine cowing, fire fighting apparatus such as ladders and valves, and the like.

In the helicopter 22 the windshield 40 is contracted back into the main body panel 38 such that an open cockpit 74 is formed in the front upper surface of the helicopter 22. A pilot 76 is depicted by his head and shoulders and becomes located in the cockpit 74 in the helicopter 22. In the van 20 the pilot 76 is not visible but is hidden within chassis member 28.

Projecting out of both the right and left sides of the main panel 38 are ratchet teeth collectively identified by the numeral 78. Projecting within the inside of both panels 42 and 44 are ratchet teeth collectively identified by the numeral 80. In the van 20 as shown in FIG. 7 the panels 42 and 44 are held upwardly against the main body panel 38 by the interaction of ratchet teeth 78 with ratchet teeth 80. In changing from the van 20 to the helicopter 22 chassis member 30 slides forward into chassis member 28 and in so doing carries the panels 42 and 44 forward. This releases ratchet teeth 78 from ratchet teeth 80 and allows panels 42 and 44 to swing downwardly into their position shown in FIG. 2 wherein they appear as landing skirts or floats for the helicopter 22.

Inside of the main body panel 38 is sliding member 82. The windshield 40 is in fact the front surface of this sliding member. Integrally formed with and projecting downwardly from upper surface 70 is a hollow boss 84. Shaft 72 slides within hollow boss 84. Sliding member 82 has a right and left side wall, the right side wall 86 being shown in the figures (its inside surface being seen in FIGS. 4 and 6 and its outside surface being seen in FIG. 5). The right and left side walls are identical. They are spaced apart from one another by a distance slightly greater than the outside dimensions of boss 84. This allows the sliding member 82 to slide within the interior of main body panel 38 with its right side wall 86 and its other identical left side wall sliding along the surface of boss 84.

The right side wall 86 and the left side wall are joined together by rear wall 88 which has a wedge shaped projection 90 located on it. The right side wall 86 and the left side wall are also connected by bottom wall 92. Boss 84 projects downwardly within the interior of main body panel 38 such that the bottom wall 92 can freely slide against the bottom surface of the boss 84. An annular flange 94 extends around the upper part of boss 84 and serves as an upper sliding surface for right side wall 86 and its identical accompanying left side wall.

Looking from front to rear of either van 20 or helicopter 22 in FIGS. 4 and 6 a channel 96 extends within right side wall 86 and an identical channel (not shown or numbered) extends within the other left side wall, first directly backward, then backward and downward and finally backward again. Boss 84 has a vertical channel on both its left and right sides collectively identified by the numeral 98. A pin 100 extends transversely with respect to the longitudinal axis of the van 20/helicopter 22 into shaft 72. The pin 100 is fixed to the shaft 72. It extends beyond the shaft 72 on both sides through the channels 98 and boss 86 and into the channels 96 in wall 86 and its identical left side wall. As sliding member 82 slides fore and aft within the main body panel 38 the pin 100 rides within channels 96. When the sliding member 82 is in a forward position this locates pin 100 downwardly, fixedly holding rotor 66 against the upper surface 70 of the van 20. In the helicopter 22 the sliding member 82 is slid rearwardly. This causes pin 100 to ride in an upward direction in channel 98 lifting the shaft 72 and the rotor 66 such that in the helicopter 22 the rotor 66 is displaced upwardly from upper surface 70.

A partition 102 fixedly rests on the upper edges of chassis member 28 and is stationary with respect to movement with regard to chassis member 28. Chassis member 30, however, is free to move beneath partition 102. Partition 102 serves several functions. Sliding member 82 slides along its upper surface. In addition, chassis member 30 slides along portions of its lower surface. Two ears collectively identified by the numeral 104, one of which is shown by hidden lines in FIGS. 4 and 6, project from the lower surface of partition 102. The ears include a hole passing through them, not shown or numbered, which serves as a bearing support for an axle 106. Inbetween the ears 104 two components are mounted and are rotatable on axle 106. One of these is the pilot platform 108 which carries the pilot 76 on its upper surface. The other component mounted on axle 106 is arm 110. A hook 112 extends upwardly on the upper surface of pilot platform 108 and a similar hook 114 extends downwardly on the lower surface of partition 102. A spring 116 extends between these two hooks through a cutout 118 in the surface of partition 102. The spring 116 biases the pilot platform 118 upwardly in the position shown in FIG. 6.

Two parallel ribs, collectively identified by numeral 120, are located on the outside surface of wall 86 of sliding member 82. This is best seen in FIG. 5. An upstanding partition 122 extends upwardly near the center of chassis member 30. Partition 122 is integrally formed with chassis member 30 and thus movement of one results in movement of the other. Near its forward end, partition 122 contains a V-shaped groove 124 which culminates into a vertically oriented channel 126. A pin 128 on one end of arm 110 fits between the parallel ribs 120. A second pin 130 on the other end of arm 110 fits within the channel 126.

Movement of either chassis member 30 or sliding member 82 is transferred to the other of these components via movement of arm 110 and interaction of the pins 128 and 130 with the appropriate parallel ribs 120 or channel 126. It will be remembered that axle 106, because of its ultimate attachment to partition 102, is in a fixed position with respect to chassis 28 and both chassis 30 and sliding member 82 are movable with respect to both chassis 28 and partition 102. Because arm 110 is free to rotate about axle 106 movement of one or the other of chassis 30 or sliding member 82 is transferred to the other. Referring to FIGS. 4, 5 and 6 (FIG. 5 being rotated 180 degrees through the plane of the figure with respect to the other two figures) it can be seen that when chassis member 30 slides rearwardly or extends out of chassis member 28, sliding member 82 is slid forward, and when chassis member 30 slides forward into chassis member 28, sliding member 82 slides backward. The fore and aft movement of chassis member 30 and sliding member 82 are therefore in opposite directions, but are coordinated.

Projecting upward from the bottom surface of chassis member 28 is a hook 132. Projecting upward from the bottom surface of chassis member 30 is a hook 134. A spring 136 extends between these two hooks and biases these two hooks toward one another which in effect biases chassis member 30 to slide into chassis member 28. The forward extent of this movement under the influence of spring 136 is seen in FIG. 6 and the rearward extent of this movement is seen in FIG. 4. A small lip 138 on the bottom of chassis member 30 abuts against chassis member 28 as seen in FIG. 6 to limit the forward movement. The rearward limit of travel of chassis 30 with respect to chassis 28 is governed by the movement of bearings 46 in the channel 140 formed between the most rearwardly extending portion 142 of chassis member 28 and main body panel 38. After moving rearwardly, chassis member 30 is locked in its most rearward position via interaction of button 68 with sliding member 82.

The portion of button 68 located within the interior of the main body panel 38 fits adjacent to sliding member 82 as is best seen in FIG. 5. A wedge-shaped projection 144 is fixed on to wall 88 of sliding member 82. A projection 146 on button 68 is positioned to interact with the projection 144. When chassis member 30 is displaced rearwardly with respect to chassis member 28, sliding member 82 is slid forward. This locates projection 146 against projection 144 as per FIG. 5 and prevents sliding member 82 from moving rearwardly. In FIG. 5 rearward movement of sliding member 82 would be to the left while in FIGS. 4 and 6 it would be to the right.

A boss 148 extends downwardly from the bottom of button 68 and a compression spring 150 fits around it. The boss 148 fits into an appropriate upstanding projection having an opening (not shown or numbered) in the partition 102. When button 68 is compressed spring 150 is compressed between unidentified projection on partition 102 and the bottom of button 68. Depression of the button 68 results in depression of projection 146 below the bottom of projection 144. This frees sliding member 82 to slide to the left in FIG. 5 and to the right in FIGS. 4 and 6. Sliding member 82 is biased to slide in this manner because of the stretching and tensing imparted to spring 136 via the interaction of chassis member 30 with sliding member 82 through the connection provided by arm 110.

When sliding member 82 is in its most rearward position (and chassis member 30 is slid into chassis member 28) the wedge 90 on the rear wall 88 of sliding member 82 pushes against rear body panel 52 causing it to rotate upwardly and outwardly as is depicted in FIG. 6. When the components noted in the preceding sentence are in this position, spring 136 is relaxed and spring 116 can pivot pilot platform 108 upwardly positioning the pilot 76 within the cockpit 74. The pilot 76 can be thus positioned because the windshield portion 40 of sliding member 82 has been withdrawn rearwardly out of the way. If downward pressure is applied to the rear body panel 52, it pushes against wedge 90 causing sliding member 82 to be slid forward. This causes chassis member 30 via interaction of arm 110 to slide backward stretching or biasing spring 136.

As sliding member 82 goes forward, the windshield 40 presses against the back of the pilot 76 and rides over its spherical head depressing it downwardly. When sliding member 82 is almost to its limit of forward travel, the wedge portion of projection 144 abuts against projection 146 depressing it and thus consequently button 68 to which it is attached. When sliding member 82 is in its forwardmost limit of travel the projections 144 and 146 are in positions such that button 68 can be slid upwardly by spring 150 thus locking sliding member 82 in its forward position which also locks chassis member 30 in its rearward position.

When the first embodiment of the toy is in the configuration of the van 20, it can be changed to the helicopter 22 by depressing the button 68. As noted above this allows rearward movement of the sliding member 82 and forward movement of the chassis 30 under the influence of spring 136. To change from the helicopter 22 to the van 20, the rear body panel 52 is depressed downwardly and inwardly to cause the forward movement of sliding member 82, the rearward movement of chassis 30 and the tensing of spring 136. Additionally, at this time the pilot 76 and the rotor 66 move as before noted. When changing from the van 20 to the helicopter 22 by depressing button 68, the panels 42 and 44 are freed to descend downwardly because of the unlocking of ratchet teeth 78 from ratchet teeth 80 as previously described. When changing from the helicopter 22 to the van 20 the panels 42 and 44 must be lifted upwardly by the operator of the toy. When the chassis member 30 is in its most rearward configuration, the ratchet teeth 80 are in a position to hold the panels 42 and 44 against main body panel 38 in the van configuration. In changing from the van 20 to the helicopter 22 the wheel base shortens and in going in reverse, from the helicopter 22 to the van 20, the wheel base is elongated.

In the second embodiment depicted in FIGS. 8 through 10 the vehicle as noted before is capable of changing from a truck 24 to a firetruck 26. This embodiment also utilizes a two component chassis wherein the components slide one within the other. This embodiment differs from the previous embodiment, however, in respect to both positioning of the body panels, the retaining means which hold the vehicle in the truck 24 configuration, exposure of the characterized occupant of the vehicle, as well as other differences which can be seen.

In keeping with the same type of description as was given for the first embodiment, a first chassis member 152 is shaped such that the second chassis member 154 can slide within it. The chassis members 152 and 154 are U-shaped as were the chassis members 28 and 30 and therefore they will not be described in great detail. Chassis member 152 carries a rear set of wheels 156 and chassis member 154 carries a front set of wheels 158. The bottom panel 160 of chassis member 154 has a cutout 162 in it which allows for positioning of projection 164, which is integrally formed on chassis 152, within the interior of cutout 162 and thus in the interior of chassis member 154.

Projection 164 carries a hook 166 on it. A projection 168 projects upwardly from the rearmost extension of chassis 154 which is somewhat L-shaped. Projection 168 carries a hook 170 on its uppermost periphery. A spring 172 extends between hook 166 and 170. Spring 172 therefore biases projections 164 and 168 toward each other which in effect causes extension of outside ends of chassis members 162 and 164 away from each other as is depicted in FIG. 10 for the firetruck 26.

Chassis 154 carries front body panel 174 on it. Pivotally mounted to front body panel 174 is movable panel 176. Movable panel 176 has axles collectively identified by the numeral 178 on both its right and left sides. These fit into appropriate bearing surfaces 180 formed on front body panel 174. A small spring 182 biases movable panel 176 into the position shown in FIG. 10. When movable panel 176 is in the position shown in FIG. 9 it serves as the roof and back wall of the cab of the truck 24. When movable panel 176 is in the position as shown in FIG. 10 it serves as portions of the interior of the cab of the firetruck 26. The driver 184 of the firetruck 26 is mounted on the interior of movable panel 176 and is thus exposed in the position shown in FIG. 10, but is hidden within the cab of the truck 24 in the position shown in FIG. 9.

A rear body panel 186 is mounted on chassis 152. Rear body panel 186 includes an upstanding hollow rectangular shaped boss 188. A rectangular shaped button 190 is located within the interior of this boss 188. The button 190 is biased upwardly by a compression spring 192 which fits against the bottom of the button 190 and the top of projection 164. It will be remembered that projection 164 is a fixed portion of chassis 152 and since rear body panel 186 is fixedly attached to chassis 152, the button 190 is always aligned directly over the projections 164.

On its forward side, at its lowermost periphery, button 190 carries a hook 194. Panel 196 forming a part of chassis 154 has an opening 198 in it. The opening is placed and sized such that hook 194 can pass through it when button 190 is depressed, but hook 194 catches against panel 196 in a manner shown in FIG. 9 when button 190 is allowed to be pushed upwardly under the bias of spring 192. The forward edge of hook 194 is wedge-shaped to allow hook 194, and thus button 190, to be depressed whenever this edge of hook 190 meets the edge of panel 196 which forms the uppermost part of opening 198. If the chassis members 152 and 154 are therefore compressed one in the other, hook 194 will interact with this edge of panel 176 and be depressed until it can slip into the opening 198 and then ascend upwardly under the influence of spring 192 catching against panel 196 to lock the two chassis members 152 and 154 together.

When chassis members 152 and 154 are locked together spring 172 is stretched tensing it. When the button 190 is depressed releasing the hook 194 such that it can be withdrawn from the opening 198, the chassis members 152 and 154 extend away from each other as spring 172 relaxes and contracts. On the top of movable panel 176 is a wedge-shaped projection 200 which appears to be an air conditioning unit on top of the cab of the truck 24. When the vehicle is in the firetruck 26 configuration this projection 200 swivels down against the surface of boss 188. When the chassis members 152 and 154 come together in converting from the firetruck 26 to the truck 24, the boss 188 pushes against the projection 200 pivoting the movable panel 176 upwardly and toward the front of front body panel 174. After the projection 200 has cleared the boss 180, corner 202 of the movable body panel 176 is positioned such that it is against square boss 188 and pressure against it completely closes the movable panel 176 over the top of front panel 174 just as hook 194 locks against panel 176.

Right and left pivotable panels 202 and 204 are hinged to rear body panel 186 via appropriate pins and bearings similar to the ones described in the other embodiment. Square boss 188 has an elongated cutout collectively identified by numeral 206 on both its right and left sides. Projecting out of the right and left hand sides of button 190 are ratchet teeth collectively identified by the numeral 208. These teeth 208 move up and down as the button 190 moves up and down. Matching ratchet teeth 210 are formed as part of panels 202 and 204. When the button 190 is in its most upward position the ratchet teeth 208 lock with and fixedly hold the ratchet teeth 210. When the button 190 is depressed the teeth 208 descend downwardly no longer interacting with the teeth 210 which allows the panels 202 and 204 to descend under their own weight. The panels 202 and 204 are closed when the embodiment is in the truck 24 configuration by the operator lifting the panels as is done in the other embodiment previously described. The limit of travel of button 190 within boss 198 is governed by the interaction of ratchet teeth 208 striking the uppermost extension of cutouts 206.

Rear movable member 212 serves as a portion of the upper and back surface of the rear body panel in the truck 24 and as a boom in the firetruck 26. A bell crank member 214 is appropriately hinged via axle 216 to rear body panel 186. A member 218 is hinged to the upper portion of the bell crank 214 via axle 220. A spring 222 is attached to the end of member 218. The back surface of member 218 and bucket 224 serve as the noted parts of truck 24 and in totality the bell crank 214, member 218 and bucket 224 serve as the boom for the firetruck 26. Extending forward from member 218 is a lip 226 whose function is as described below.

An upstanding projection 228 which is shown in FIGS. 9 and 10 extends upwardly from the L-shaped portion of chassis member 154 offcenter from projection 168. When the chassis members 152 and 154 compress together the projection 228 extends toward the rear of the vehicle. As the chassis members are moving together—that is, as the vehicle changes from the firetruck 26 to the truck 24—the projection 228 engages the lowermost portion of bell crank 214 (also offcenter with respect to projection 168) rotating it about axle 216 until it becomes lodged against a projection 230 shaped as a fire hose reel located on rear body panel 186. As the bell crank 214 rotates the end of member 218 wherein lip 226 is located engages against the surface of boss 188 and further rotation of the bell crank 214 causes the opposite end of member 218 to descend downwardly toward the bell crank 214. The bucket 224 can then flip or rotate from its position shown in FIG. 10 to its position shown in FIG. 9. The rear movable member 212 will assume the orientation shown in FIG. 9 as hook 194 engages panel 196. When left pivotable panel 204 is lifted upwardly and locked via ratchet teeth 208 and 210, a portion of it slips underneath lip 226 ensuring that member 218 and bucket 224 will be maintained in the position shown in FIG. 9.

In operation, then, to change from the truck 24 to the firetruck 26 button 190 is depressed which releases the connection between the two chassis members 152 and 154 allowing them to extend outwardly under the influence of spring 172. The extent of this extension of the chassis members 152 and 154 is governed by the interaction of projection 154 with the end of the cutout 162. As the chassis members 152 and 154 extend the rear movable member 212 is freed to allow it to pivot upwardly to form the boom, the panels 202 and 204 are freed allowing them to extend downwardly exposing their inside surfaces, and the movable panel 176 rotates exposing the driver 184. Certain firetruck-like apparatus are located on the inside surfaces of the panels 202 and 204 and body 186 contributing to the firetruck appearance of the firetruck 26. To convert back to the truck 24, the front and rear of the firetruck 26 are compressed together stretching spring 172 moving the rear movable member 212 downwardly and the movable panel 176 forward as previously described until once again the truck 24 is formed. Lifting the panels 202 and 204 complete the conversion to the truck 24.

We claim:

1. A toy vehicle which comprises:

a chassis, said chassis including a plurality of wheels attached to said chassis for supporting said vehicle on a support surface;

a vehicle body attached to said chassis, said body having a front, a back, a top, a left side and a right side;

said body including a left side body member movably mounted about a hinge to said left side of said body, said body including a right side body member movably mounted about a hinge to said right side of said body, said left side body member in a first closed configuration forming a portion of the left side and top of said body, said right side body member in said first closed configuration forming a portion of said right side and said top of said body, both said left and said right side body members pivoting about their respective hinges from said first closed configuration to a second open configuration to locate the totality of said left side body member outboard of said left side and the totality of said right side body member outboard of said right side respectively to increase the width of said body as measured between said left side and said right side in said first closed configuration and said left side and said right side body members in said second open configuration;

a third body member movably mounted to said body so as to form a portion of the top of said body in said first configuration and having at least a portion thereof which extends away from said top of said body in said second configuration, said third body member moving on said body both (a) between said first and said second configurations and (b) with respect to said body when in said second configuration;

spring means operatively associated with said third body member so as to bias said third body member from said first configuration to said second configuration;

retaining means operatively associated with said third body member to maintain said third member in said first configuration against the bias of said spring means;

means operatively associating said third body member with said left side and said right side body members so as to convey motion of said third body member, in moving from said first configuration to said second configuration, to said left side and said right side body members to move said left side and said right side body members from said first configuration to said second configuration.

2. The toy vehicle in claim 1 including:

a portion of said back of said body movable with respect to the remainder of said back of said body between said first and said second configurations, said portion formed as a part of one of said third member or said left side and said right side body members.

3. The toy vehicle of claim 1 wherein:

said third body member is capable of rotating with respect to said vehicle body when in said second configuration.

4. The toy vehicle of claim 1 wherein:

said third body member includes at least two sections, the first of which is movable with respect to said body and the second of which is movable with respect to said first section.

5. The toy vehicle of claim 1 wherein:

said left side and said right side body members each have an essentially vertically oriented panel which forms a portion of one of the respective sides of said body in said first configuration and an essentially horizontally oriented panel which forms a portion of said top of said body when in said first configuration, said essentially horizontally oriented portion positioned at about a 90 degree angle with respect to said vertically oriented portion;

said vertically oriented portion oriented essentially vertically with the respective side of said body when the respective left and right side body members are in both said first and said second configuration.

* * * * *